US007602337B2

(12) United States Patent
Choi et al.

(10) Patent No.: US 7,602,337 B2
(45) Date of Patent: Oct. 13, 2009

(54) ANTENNA ARRAY INCLUDING A PHASE SHIFTER ARRAY CONTROLLER AND ALGORITHM FOR STEERING THE ARRAY

(75) Inventors: Chang W. Choi, Cerritos, CA (US); Alan R. Keith, Yorba Linda, CA (US); Wesley F. Walloch, Newport Castle, CA (US)

(73) Assignee: The Boeing Company, Irvine, CA (US)

( * ) Notice: Subject to any disclaimer, the term of this patent is extended or adjusted under 35 U.S.C. 154(b) by 321 days.

(21) Appl. No.: 11/564,928

(22) Filed: Nov. 30, 2006

(65) Prior Publication Data

US 2008/0129595 A1 Jun. 5, 2008

(51) Int. Cl.
*H01Q 3/36* (2006.01)

(52) U.S. Cl. ..... 342/375; 342/377

(58) Field of Classification Search ..... 342/368, 342/372–375, 377

See application file for complete search history.

(56) References Cited

U.S. PATENT DOCUMENTS

| | | | | |
|---|---|---|---|---|
| 4,378,559 | A | 3/1983 | Rittenbach | |
| 5,103,232 | A | 4/1992 | Chang et al. | |
| 5,537,367 | A * | 7/1996 | Lockwood et al. | 342/372 |
| 5,861,845 | A * | 1/1999 | Lee et al. | 342/375 |
| 6,900,770 | B2 | 5/2005 | Apostolos | |

FOREIGN PATENT DOCUMENTS

| | | | |
|---|---|---|---|
| WO | 2006110026 | | 10/2006 |
| WO | WO 2006/110026 | A1 * | 10/2006 |
| WO | 2006130795 | | 12/2006 |
| WO | WO 2006/130795 | A2 * | 12/2006 |

OTHER PUBLICATIONS

Telecommunications: Glossary of Telecommunication Terms, Federal Standard 1037C, p. M-14, 1996.*

Clenet et al. "Graphical investigation of quatisation effects of phase shifters on array patterns." Defense Research Establishment Ottawa, Nov. 2000, Canada, chapters 2 & 3.

Jenn et al. "Inband scattering from arrays with series feed networks." IEEE Transactions on Antennas and Propagation, IEEE Service Center, Piscataway, NJ, US, vol. 43, No. 8, Aug. 1, 1995, pp. 867-873.

Akkaraekthalin et al. "Signal-to-Interference Ratio Improvement by Using a Phased Array Antenna of Switched-Beam Elements." IEEE Transactions on Antennas and Propagation, IEEE Service Center, Piscataway, NJ, US, vol. 53, No. 5, May 1, 2005, pp. 1819-1828.

International Search Report, corresponding to International Patent Application No. PCT/US2007/085536, dated Jun. 17, 2008.

(Continued)

*Primary Examiner*—Thomas H Tarcza
*Assistant Examiner*—Fred H Mull
(74) *Attorney, Agent, or Firm*—Charles L. Moore; Moore & Van Allen, PLLC

(57) ABSTRACT

An antenna system may include an antenna array which includes a plurality of radiating elements. The system may also include a phase shifter controller and algorithm to apply a non-periodic modulation to an excitation of each radiating element.

26 Claims, 5 Drawing Sheets

OTHER PUBLICATIONS

Invitation to Pay Additional Fees, corresponding to International Patent Application No. PCT/US2007/085536, dated Jun. 17, 2008.
Herscovici, Naftali, Extremely Wide-Band Antennas For Wireless Communication, http://bennyhills.fortunecity.com/miller/433/notch/notch.htm, Sep. 14, 2006.
Manasson, V.A., et al., An Optically Controlled MMW Beam-Steering Antenna Based on a Novel Architecture, IEEE, 1997.
Chandler, Cole, Electronically Steerable Antenna (ESA) Based on Semiconductor Plasma Array (SPA) for Missile and Smart Munition Applications, Waveband, Feb. 2003.

* cited by examiner

ANTENNA ARRAY INCLUDING A PHASE SHIFTER ARRAY CONTROLLER AND ALGORITHM FOR STEERING THE ARRAY

BACKGROUND OF THE INVENTION

The present invention relates to antennas, antenna arrays and the like, and more particularly to a low-bit phase shifter phased array antenna including a phase shifter controller and algorithm adapted for steering or pointing a beam from the array in a desired direction.

Currently, antenna arrays with densely placed elements, for example arrays with spacing approximately 0.1 wavelengths between elements, treat the array as analogous to a phase grating. In this approach phase shifter settings are determined by an optical grating equation for each row of the array with a phase modulation period, Λ, given by equation 1:

$$\Lambda = \frac{\lambda}{n - \sin(\theta_o)} \quad (1)$$

Where λ is the frequency wavelength, n is the square of the relative dielectric constant of the feeding line (in an optical implementation, this would be the index of refraction of the lens material), and $\theta_o$ is the desired scan angle. The phase shifter settings are then set to achieve a square-wave phase modulation with the computed period. In other words, a number of phase shifters that are contained in the distance Λ/2 would be set to 0 degree phase. The next set of phase shifters in distance Λ/2 would be set to 180 degree phase. The result is a periodic phase modulation with period Λ. A two dimensional scan is then realized by applying the phase modulation to the rows (instead of elements in a row) to steer the beam in the other dimension. The resulting phase modulation is then a summation of the row phase grating and the orthogonal modulation applied to each row. However, this periodic phase modulation gives inferior performance because of high side lobes in the radiation pattern and other anomalies due to the accumulation of residual errors. An additional drawback to this approach is that the beam positions are discrete depending on the ability of the elements to achieve the period Λ.

BRIEF SUMMARY OF THE INVENTION

In accordance with an embodiment of the present invention, an antenna system may include an antenna array including a plurality of radiating elements. The system may also include a phase shifter controller and algorithm to apply a non-periodic phase modulation to an excitation of each radiating element.

In accordance with another embodiment of the present invention, an antenna system may include an antenna array including a plurality of radiating elements and a phase shifter associated with each radiating element. The antenna system may also include a delay line or other component to provide a progressive phase delay to each radiating element.

In accordance with another embodiment of the present invention, an antenna system may include an antenna array. The antenna array may include a substantially conically-shaped face. A plurality of radiating elements may be formed in the substantially conically-shaped face and a plurality of feed lines may be coupled respectively to each of the plurality of radiating elements in the substantially conically-shaped face. A phase shifter may be associated with each feed line. The antenna array may also include an array aperture face. A plurality of radiating elements may be formed in the array aperture face, each respectively coupled to one of the feed lines. The antenna system may further include a phase shifter controller and algorithm to produce a non-periodic phase modulation across the antenna array.

In accordance with another embodiment of the present invention, a method to steer an electronically steerable antenna array may include feeding electromagnetic energy to the antenna array. The method may also include applying a non-periodic modulation to the antenna array. Feeding the electromagnetic energy may involve space-feeding the electromagnetic energy to the antenna array.

In accordance with another embodiment of the present invention, a method to steer an electronically steerable antenna array may include associating a phase shifter with each radiating element of the antenna array. The method may also include providing a progressive phase delay to each radiating element to produce an electromagnetic wave propagating in a desired direction and to substantially prevent production of any undesirable lobes, such as grating lobes, high side lobes or the like, in a radiation pattern of the antenna array.

In another embodiment of the present invention, the progressive phase delay to each radiating element may be provided by a delay line or other component. A net phase at each radiating element may consist of a phase delay from the delay line and a phase shifter. The net phase across the antenna elements or radiating elements produces an electromagnetic wave propagating in the desired direction and substantially prevents production of any grating lobes in the radiation pattern of the antenna array.

Other aspects and features of the present invention, as defined solely by the claims, will become apparent to those ordinarily skilled in the art upon review of the following non-limited detailed description of the invention in conjunction with the accompanying figures.

DETAILED DESCRIPTION OF THE INVENTION

The following detailed description of embodiments refers to the accompanying drawings, which illustrate specific embodiments of the invention. Other embodiments having different structures and operations do not depart from the scope of the present invention.

As will be appreciated by one of skill in the art, the present invention may be embodied as a method, system, or computer program product. Accordingly, portions of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system."

The present invention is described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

Figure 1:
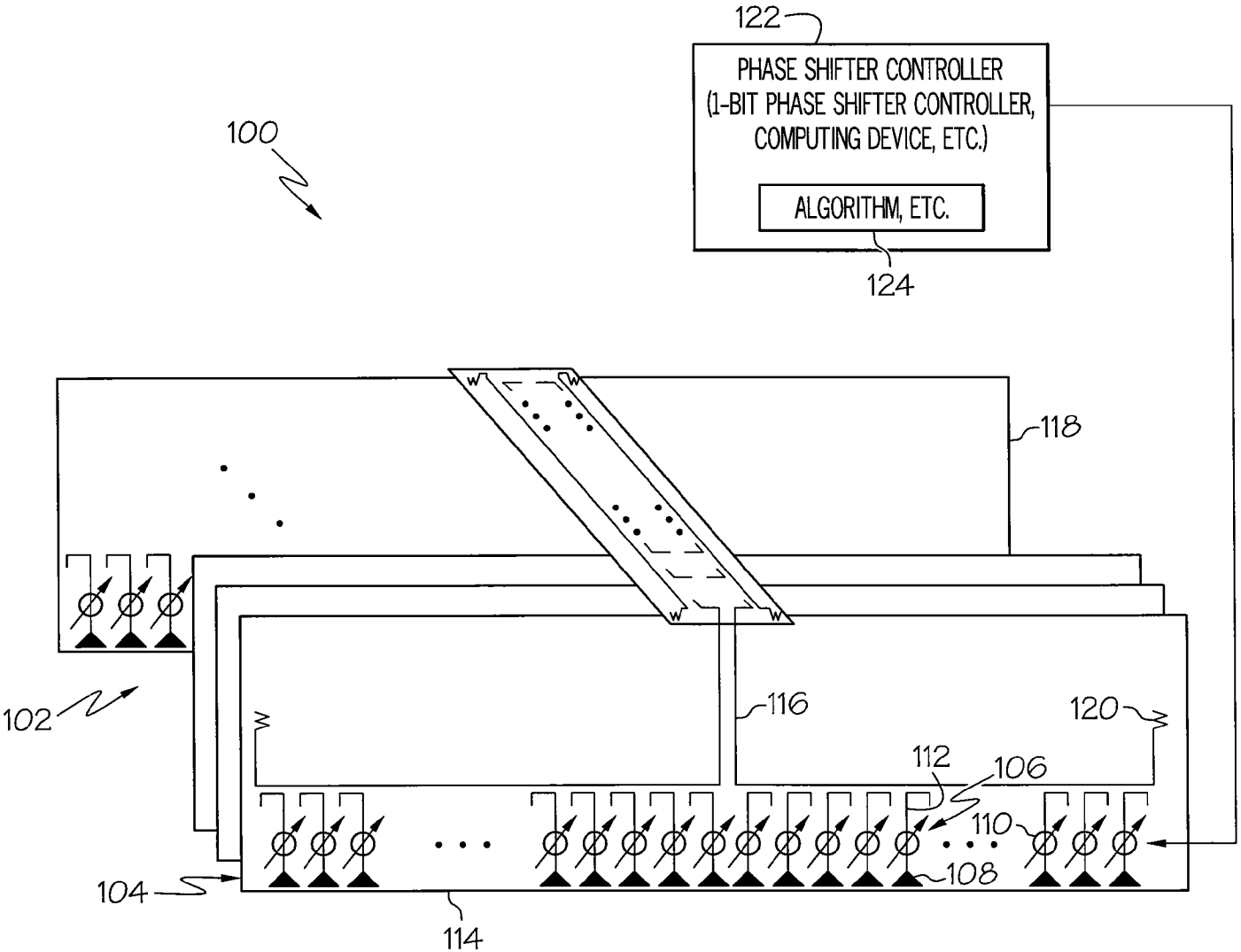
FIG. 1 is an illustration of an example of an antenna system including an antenna array of radiating elements, a phase shifter, and a phase shifter controller and algorithm adapted to direct the array in accordance with an embodiment of the present invention.

FIG. 1 is an illustration of an example of an antenna system 100 including an antenna array 102 in accordance with an embodiment of the present invention. The antenna array 102 may include a plurality of rows 104 of antenna elements 106. Each antenna element 106 may include an integrated radiating element 108, a phase shifter 110, and a coupler line 112. The radiating element 108 may be formed in an array face 114. Each antenna element 106 may also have a phase delay from a feedline 116 respectively coupled to each of the plurality of radiating elements 108. A phase shifter 110 may be associated with each coupler line 112. Each phase shifter 110 may be a one-bit phase shifter or similar device. Each of the phase shifters 110 may be uniquely set to produce an electromagnetic or radio frequency (RF) wave or beam oriented in a selected direction and with optimum transmission characteristics as described in more detail herein.

The antenna elements 106 may be formed with each row 104 on a card or substrate 118 as shown in the embodiment of the present invention illustrated in FIG. 1. The substrate 118 may be a dielectric or semiconductor type material. Multiple substrates 118, each with a row 104 of antenna elements 106, may be combined or grouped to form the antenna array 102. The antenna array 102 may define a substantially square or rectangular array; although other configurations may be formed as well.

The transmission line 116 or feedline on each substrate 118 or card may feed electromagnetic energy or signals to each of the coupler lines 112 in the row 104 on a particular substrate 118. The transmission line 118 may be terminated by an RF load 120 to balance the transmission line 116 and to substantially prevent any reflection of RF energy or signals. The transmission line 116 may provide a progressive phase delay to the coupler lines 112.

The antenna system 100 may also include a phase shifter controller 122 and algorithm 124 or the like. An example of a method or algorithm that may be used for the phase shifter controller 122 and algorithm 124 or one-bit phase shifter controller will be described in more detail with reference to FIG. 3. The phase shifter controller 122 and algorithm 124 may be adapted to apply a non-periodic modulation or to induce a non-periodic modulation in the antenna array 102, or in an excitation of each radiating element 108, by selecting the phase setting for each phase shifter 110. A phase delay feeding line 116 may be used to apply a slowly varying progressive phase delay across the antenna elements 106 to steer an antenna beam generated by the antenna array 102 while substantially preventing production of any undesirable lobes, such as grating lobes or high side lobes, in a radiation pattern of the antenna array 102.

Figure 4:
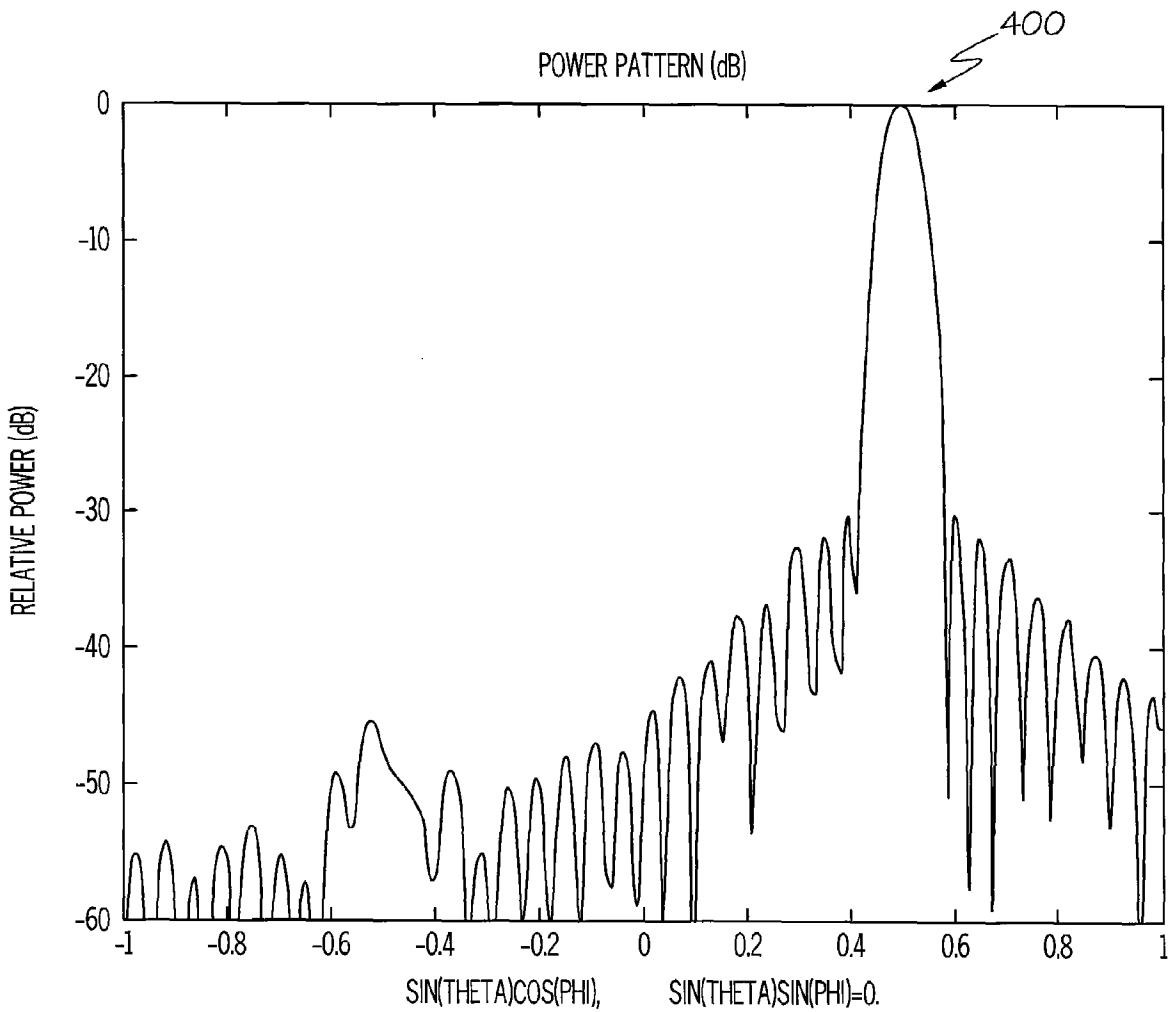
FIG. 4 is an illustration of an antenna radiation pattern from an antenna array system including a phase shifter on each antenna element in accordance with an embodiment of the present invention.
Figure 5:
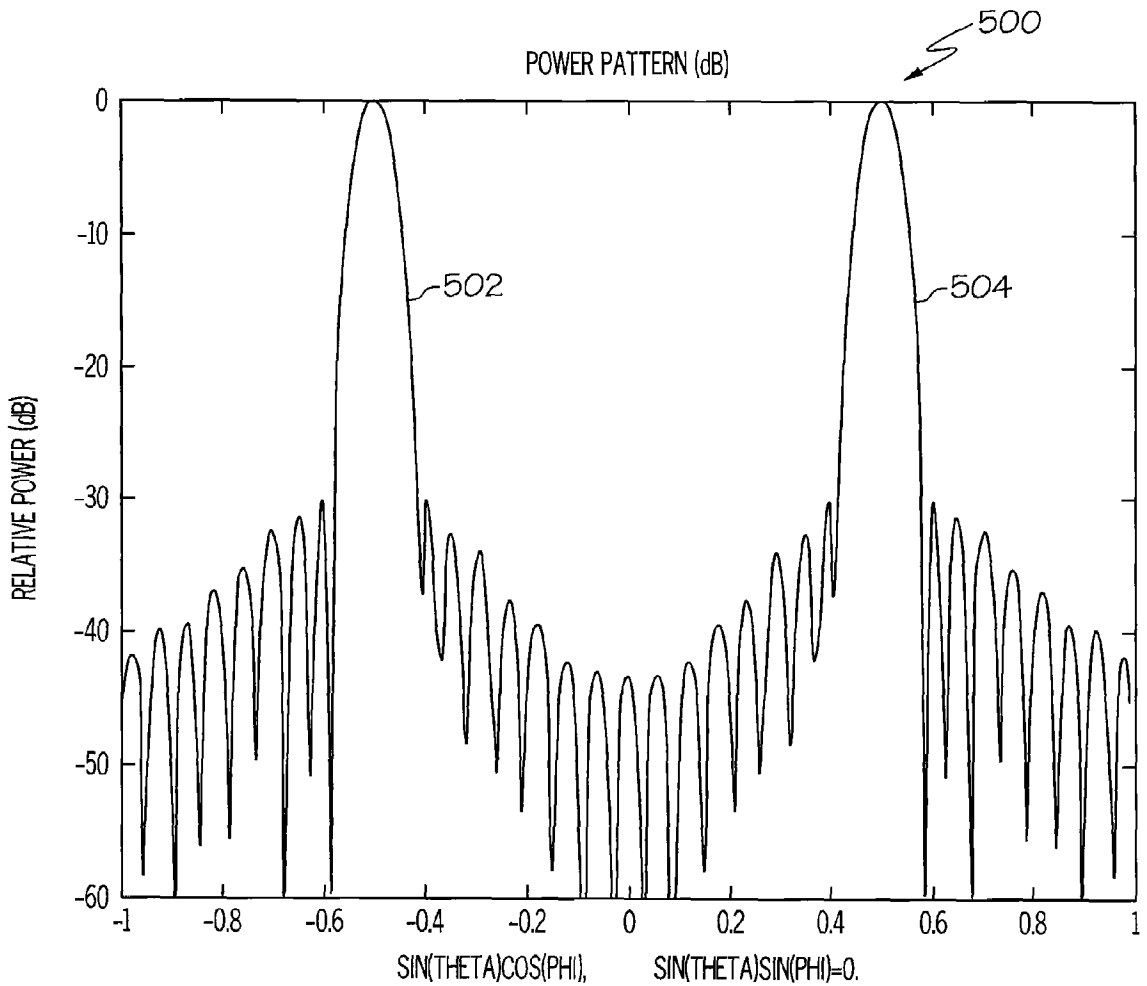
FIG. 5 (PRIOR ART)
FIG. 5 is an illustration of an antenna radiation pattern from an antenna array system illustrating a grating lobe.

The phase shifter controller 122 and algorithm 124 take into account the slowly varying progressive phase delay for each radiating element 108 and sets the phase shifter 110 to minimize the error between the ideal phase required at each radiating element 108 and the implemented phase. A net phase at each radiating element 108 may include the phase delay from the feed line 116 and the phase shifter 110. The net phase across the antenna elements 106 produces an electromagnetic wave propagating in a selected direction and substantially prevents production of any undesirable lobes, such as grating lobes or high quantization lobes, in a radiation pattern of the antenna array 102. A resulting radiation pattern 400 with application of the progressive phase delay is illustrated in FIG. 4. An example without application of the progressive phase delay, such as a uniform phase distribution from a corporate feed, is illustrated in the radiation pattern 500 with a grating lobe 502 as illustrated in FIG. 5.

Figure 2:
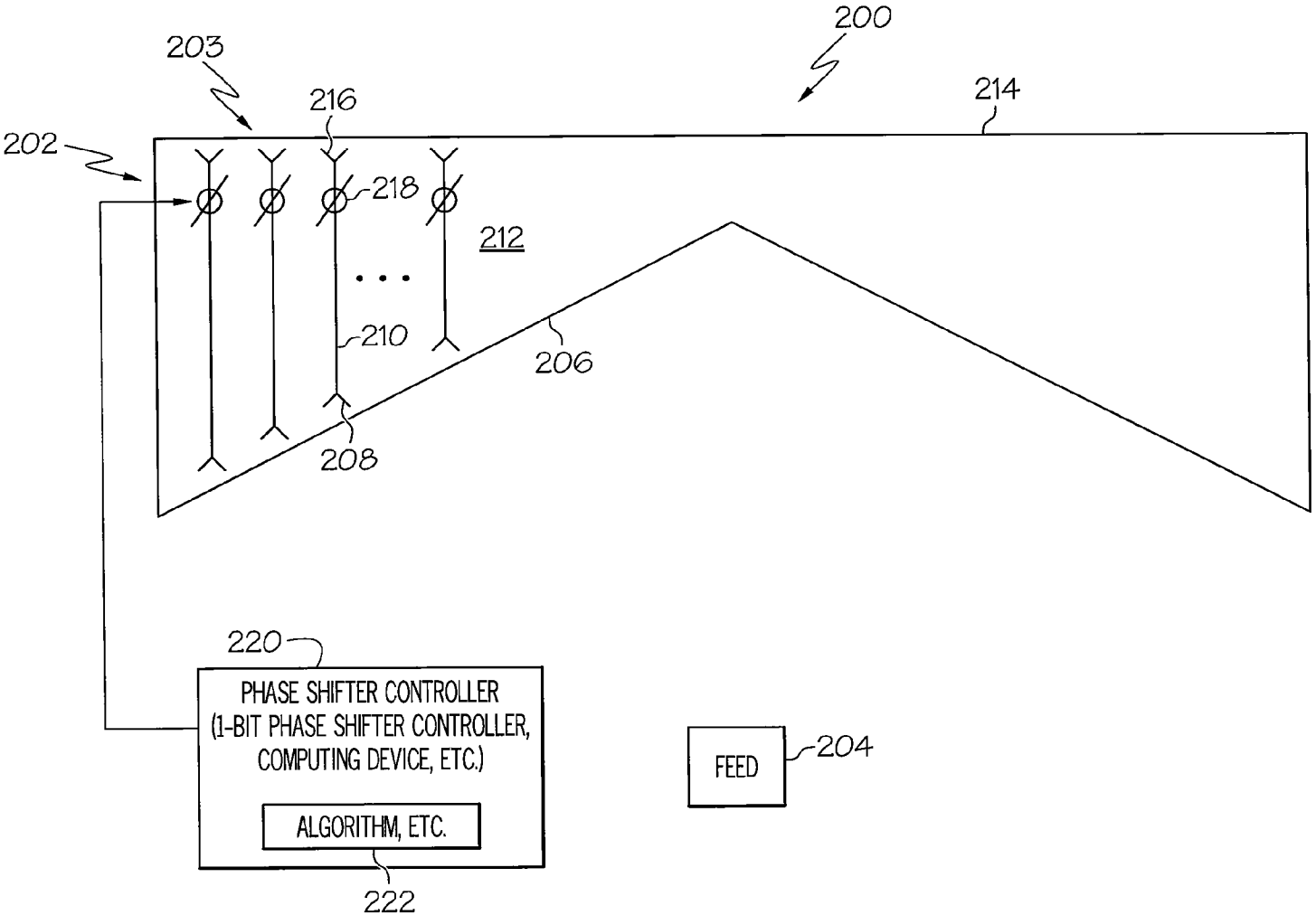
FIG. 2 is an illustration of another example of an antenna system including an array of radiating element pairs, a phase shifter, and a phase shifter controller and algorithm adapted to direct the array in accordance with another embodiment of the present invention.

FIG. 2 is an illustration of another example of an antenna system 200 including an antenna array 202 in accordance with another embodiment of the present invention. The array 202 may include a plurality of radiating element pairs 203. The antenna array 202 may be space-fed by a feed horn 204 or the like. The feed horn 204 may be a hybrid mode horn (e.g., $HE_{11}$) or the like to direct electromagnetic energy or radio waves to the antenna array 202.

The antenna array 202 may include a substantially conically-shaped face 206. The conical face 206 may be a layer of dielectric material or a similar material. A plurality of radiating elements 208 may be formed in the conical face 206. The radiating elements 208 may receive (or transmit) electromagnetic waves or energy from (to) the feed horn 204. A plurality of feed lines 210 or feed delay lines may be respectively connected to each of the plurality of radiating elements 208. The feed lines 210 may be formed by a conductive material or semiconductor and disposed in a substrate 212. The substrate 212 may be formed from a dielectric material. The feed lines 210 or feed delay lines may each have an effective dielectric constant and length to provide a progressive phase delay to each element 203 in the array 202. The progressive phase delay may vary at a predetermined rate.

The antenna array 202 may also include a substantially flat array aperture face 214 opposite to the conical face 206. A radiating element 216 may be formed in the array aperture face 214 for each of the feed delay lines 210. Accordingly, each feed delay line 210 connects a radiating element 208 in the conical face 206 and to another radiating element 216 formed in the substantially flat array aperture face 214 to define the radiating element pairs 203.

A phase shifter 218 may be associated with each feed delay line 210. The phase shifters 218 may be one-bit phase shifters or the like. Each of the phase shifters 218 may be uniquely set to produce an electromagnetic or radio frequency (RF) wave or beam oriented in a selected direction and with optimum transmission characteristics as described herein.

The antenna system 200 may also include a phase shifter controller 220 and algorithm 222 or the like. An example of a method that may be used with the phase shifter controller 220 or for algorithm 222 to set the one-bit phase shifters will be described in more detail with reference to FIG. 3. The phase shifter controller 220 and algorithm 222 may be adapted to apply a non-periodic or periodic modulation or to induce a non-periodic or periodic modulation across the antenna array 202. The phase shifter controller 220 and algorithm 222 work in conjunction with the progressive phase delay across the radiating elements 216 to scan the antenna beam while substantially preventing production of any undesirable lobes, such as grating lobes or high quantization lobes, in a radiation pattern of the antenna array 202.

The phase shifter controller 220 may be a computing device, microprocessor or the like programmed to implement the algorithm 222 of the present invention. The phase shifter controller 220 and algorithm 222 may control operation of the array 202 by controlling the phase shifter 218 of each element 216 to produce a non-periodic phase modulation which may produce an electromagnetic wave propagating in a selected direction and substantially prevents production of any undesirable lobes in the radiation pattern of the antenna array 202.

Figure 3:
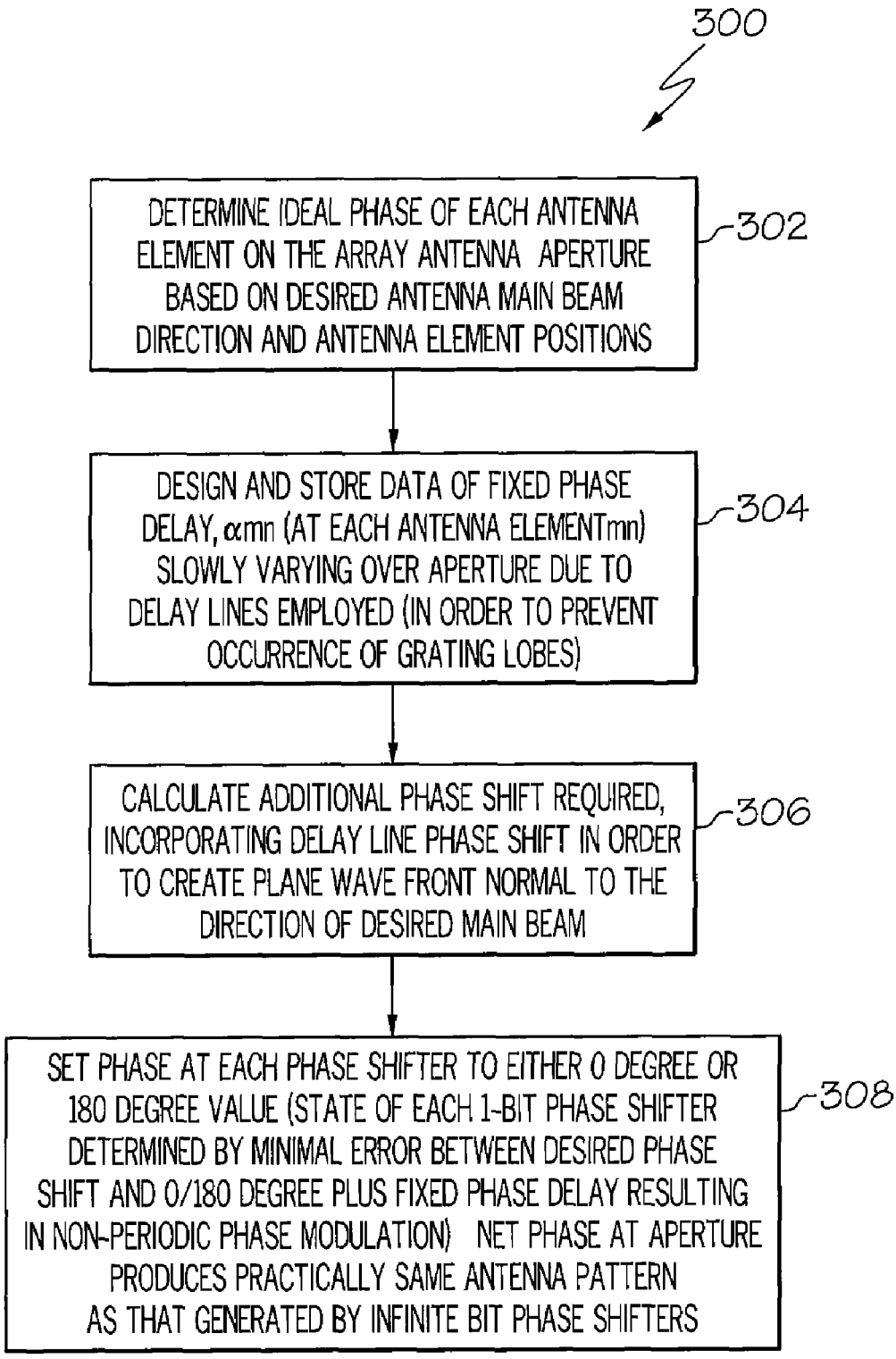
FIG. 3 is a flow chart of an example of a method to set a phase shifter of each element of an antenna array to direct the array or point a beam from the array in a desired direction in accordance with an embodiment of the present invention.

FIG. 3 is a flow chart of an example of a method 300 to set a phase shifter of each element of an antenna array to direct the array or point a beam from the array in a desired direction in accordance with an embodiment of the present invention. The method 300 may be used to steer an antenna array, such as the antenna array 102 of FIG. 1, antenna array 202 of FIG. 2 or other steerable antenna array. The method 300 may be embodied in the phase shifter controller 122 and 220 or algorithms 124 and 222 of FIGS. 1 and 2, respectively.

In block 302, an ideal phase of each antenna element on the aperture of an antenna system may be determined based on a desired antenna pointing direction or main beam pointing direction and the element location within the array. For example, in a linear array, if the desired angular direction is $\theta_0$, then the ideal desired phase, $\phi$ of each element in a linear array will be as indicated in equation 2:

$$\phi_n=(n-1)kd\sin(\theta_0) \tag{2}$$

Where n is the element number in the row, k is the wave number ($2\pi/\lambda$), and d is the spacing between elements. In other words, the distance from the first element to the nth element is (n−1)*d. This ideal element phasing results in a linear progressive phase across the linear array which produces a plane wave propagating in the desired direction $\theta_o$. For a two dimensional array, the ideal phase at the element in the $m^{th}$ row and $n^{th}$ column for a beam position at ($\theta_o$, $\phi_o$), is given by equation 3:

$$\begin{aligned}\phi_{mn} &= -\vec{k}\cdot\vec{r}_{mn} \\ &= -k(x_{mn}\sin(\theta_o)\cos(\varphi_o)+y_{mn}\sin(\theta_o)\sin(\varphi_o))\end{aligned} \tag{3}$$

In practice, the phase at each element cannot be adjusted to the ideal phase from equation 3 (and in block 302) without infinite bit phase shifters. In accordance with an embodiment of the present invention, a slowly varying progressive phase delay, $\alpha_{mn}$, may be applied across the array at each of the (m×n) antenna elements. In embodiment 100, the phase delay is realized with the feed line 116, while in embodiment 200, the phase delay is realized by individual delay lines 210 for each element 216 combined with the spatial phase delay from the feed horn 204 to each radiating element 208.

In block 304, a fixed phase delay, $\alpha_{mn}$, is given by design to each antenna element (or between antenna element pairs) which varies slowly over the aperture (radiating element to radiating element) and prevents the occurrence of grating lobes. The phase delay may be slowly varying and may be increasing or decreasing on an order of about 50 degrees to about 60 degrees between elements. In block 306, additional phase required by equation (3) is computed. The net phase shift required at each element for plane wave generation is the phase calculated from equation (3) minus the fixed phase delay, $\alpha_{mn}$, provided by the delay line.

In block 308, each phase shifter, such as phase shifters 110 in FIG. 1 or phase shifters 218 in FIG. 2 or the like, may be uniquely set to provide a minimum error between the desired phase and the implemented phase. The implemented or net phase includes the progressive phase from block 304 across the array and the phase setting from each phase shifter to produce the plane wave in a desired direction.

In block 308, the phase at each one-bit phase shifter may be set to either a 0 degree value or a 180 degree value to provide the setting substantially closest to the net phase needed. The state of each phase shifter may be determined by requiring minimal error between the desired phase from equation (3) and a fixed phase delay plus the one-bit setting to produce a non-periodic modulation. The minimum error may be expressed by equation 4:

$$\text{Minimum Error} = \text{modulus}\left[\left(-\vec{k}\cdot\vec{r}_{mn}+\alpha_{mn}\right), 2\pi\right] + \begin{matrix}0\\ \pi\end{matrix}\ (\text{1 bit phase shifter setting}) \tag{4}$$

Where $\alpha_{mn}$ is the phase delay at the input to the $mn^{th}$ phase shifter whose location is given by the coordinates $x_{mn}$, $y_{mn}$ (where $r_{mn}=\text{sqrt}(x_{mn}^2+y_{mn}^2)$). The one-bit phase shifter setting would be chosen (0 or $\pi$) to produce the smallest error between the ideal phase setting and the one-bit phase shifter implementation. In an embodiment of the current invention the one-bit phase shifter setting results in a non-periodic modulation in the antenna elements over the array aperture face. This operation is performed in the phase shifter controller 122 or 220 in the respective embodiments 100 (FIG. 1) and 200 (FIG. 2).

FIG. 4 is an illustration of an antenna radiation pattern 400 from an antenna array system including the phase shifter module in accordance with an embodiment of the present invention. The system may be similar to the system 100 of FIG. 1 or the system 200 of FIG. 2. The combination of the one-bit phase shifter along with the progressive phase delay substantially prevents the production of any undesirable lobes, such as grating lobes and high side lobes, normally cause by residual error due to quantization.

FIG. 5 is an illustration of an antenna radiation pattern 500 from a corporate-fed array antenna. In a corporate-fed array antenna, each radiating element on the aperture is fed with an equal phase. There is no progressively varying phase over the aperture similar to that provided by the present invention as described above. When the corporate-fed array antenna is scanned employing one-bit phase shifters, a grating lobe 502 comes into a visible space as shown in FIG. 5. The beam 504 ($k_x$=0.5) is the scanned beam and the beam 502 ($k_x$=−0.5) is a grating lobe.

The delay line 116 of antenna system 100 (FIG. 1) and the delay lines 210 of antenna system 200 of FIG. 2 each move a center of a scanned beam ($K_{xy}$) space such that grating lobes do not come into the visible space from the imaginary space. The progressive phase delay of the present invention achieves this effect. The rate of progressive phase delay may depend on or is a function of the frequency, spacing between contiguous radiating elements, number of bits in the phase shifters, and dielectric constant of the delay line. In the case of delay lines 210, the varying lengths of the delay lines 210 are also a key factor of the progressive phase delay rate. The rates may be all positive, all negative or combination of positive and negative.

The flowcharts and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems which perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. An antenna system, comprising:

an antenna array including a plurality of radiating elements;

a phase shifter associated with each antenna element;

a single phase shifter controller and algorithm to control each of the phase shifters and to apply a non-periodic modulation to an excitation of each radiating element; and a delay line to apply a varying progressive phase delay across the radiating elements in the antenna array, wherein the varying progressive phase delay varies at a rate to substantially prevent production of any grating lobes in a radiation pattern of the antenna array.

2. The antenna system of claim 1, wherein each phase shifter is uniquely settable to produce an electromagnetic wave propagating in a selected direction.

3. The antenna system of claim 1, wherein each phase shifter is set to substantially prevent production of undesirable lobes in a radiation pattern of the antenna array.

4. The antenna system of claim 1, wherein each phase shifter comprises a one-bit phase shifter associated with each antenna element.

5. The antenna system of claim 4, wherein a state of each one-bit phase shifter is determined by a minimum error between a desired phase and a fixed phase delay plus a one-bit phase shifter setting.

6. The antenna system of claim 5, wherein the one-bit phase shifter setting is one of a 0 degree setting and a 180 degree setting.

7. The antenna system of claim 1, further comprising a transmission line to feed radio frequency energy to the antenna array.

8. The antenna system of claim 1, wherein the antenna array comprises a circular symmetric configuration.

9. The antenna system of claim 1, further comprising a space-fed configuration to feed the antenna array.

10. The antenna system of claim 1, further comprising:

a coupler line connected to each radiating element; and wherein the phase shifter comprises a one-bit phase shifter associated with each coupler line.

11. The antenna system of claim 1, wherein the antenna array comprises:

a substantially conically-shaped face;

a plurality of radiating elements formed in the substantially conically-shaped face;

a plurality of feed delay lines coupled respectively to each of the plurality of radiating elements in the substantially conically-shaped face;

a one-bit phase shifter associated with each feed delay line;

an array aperture face; and a plurality of radiating elements formed in the array aperture face and connected to the feed delay lines.

12. The antenna system of claim 1, further comprising a feed horn electromagnetically feeding the substantially conically-shaped face of an antenna array.

13. An antenna system, comprising:

an antenna array including a plurality of radiating elements;

a phase shifter associated with each radiating element; and a separate delay line associated with each phase shifter to provide a progressive phase delay to each radiating element, wherein the progressive phase delay is applied to the radiating elements at a varying progressive rate to produce a plane wave propagating in a selected direction relative to the array and to substantially prevent production of an undesirable lobes in a radiation pattern of the antenna array.

14. The antenna system of claim 13, wherein each phase shifter is uniquely settable to produce an electromagnetic wave propagating in a selected direction.

15. The antenna system of claim 13, wherein a state of each phase shifter is determined by a minimum error between a desired phase and a fixed phase delay plus a one-bit phase shifter setting.

16. The antenna system of claim 13, further comprising a phase shifter controller and algorithm to set the phase shifter associated with each radiating element to minimize error between an ideal phase at each radiating clement and an implemented phase based on the progressive phase delay for each radiating element.

17. The antenna system of claim 13, wherein a rate of the progressive phase delay is dependent upon a group comprising a frequency of signals being transmitted or received by the antenna system, a spacing between contiguous radiating elements, a numbers of bits in each phase shifter, a dielectric constant of the delay line, and a length of the delay line.

18. A method to steer an electronically steerable antenna array, the method comprising:

feeding electromagnetic energy to the antenna array, wherein the antenna array includes a plurality of radiating elements;

applying a non-periodic modulation to the antenna array; and applying a varying progressive phase delay across the antenna array to provide an optimum phase at each radiating element, wherein a phase shifter is associated with each of the plurality of radiating elements and a delay line is associated with each phase shifter to apply the varying progressive phase delay to produce an electromagnetic wave propagating in a selected direction and to substantially prevent production of any grating lobes in a radiation pattern of the antenna array.

19. The method of claim 18, further comprising uniquely setting each phase shifter to produce the electromagnetic wave propagating in the selected direction relative to the antenna array.

20. The method of claim 19, further comprising determining a state of each phase shifter by a minimum error between a desired phase and a fixed phase delay plus a phase shifter setting.

21. The method of claim 20, further comprising setting the phase shifter setting to one of a 0 degree setting and a 180 degree setting.

22. A method to steer an electronically steerable antenna array, the method comprising:

associating a phase shifter with each radiating element of the antenna array;

associating a delay line with each phase shifter; and providing a progressive phase delay to each radiating element using the delay line to produce an electromagnetic wave propagating in a desired direction and to substantially prevent production of any undesirable lobes in a radiation pattern of the antenna array.

23. The method of claim 22, further comprising determining a state of each phase shifter by a minimum error between a desired phase and a fixed phase delay plus a phase shifter setting.

24. The method of claim 23, further comprising setting the phase shifter setting to one of a 0 degree setting and a 180 degree setting.

25. The method of claim 22, further comprising applying a non-periodic modulation to the antenna array.

26. The method of claim 22, further comprising providing the progressive phase delay at a rate dependent upon a group comprising a frequency of signals being transmitted or received by the array, a spacing between contiguous radiating elements of the array, a numbers of bits in each phase shifter associated with each radiating element, a dielectric constant of a delay line associated with each radiating element, and a length of the delay line associated with each radiating element.

* * * * *